United States Patent [19]

Katagi et al.

[11] Patent Number: 4,500,882

[45] Date of Patent: Feb. 19, 1985

[54] ANTENNA SYSTEM

[75] Inventors: Takashi Katagi, Kanagawa; Seiji Mano, Fujisawa, both of Japan

[73] Assignee: Mitsubishi Denki Kabushiki Kaisha, Tokyo, Japan

[21] Appl. No.: 317,847

[22] Filed: Nov. 3, 1981

[30] Foreign Application Priority Data

| | | | |
|---|---|---|---|
| Nov. 5, 1980 | [JP] | Japan | 55-155536 |
| Nov. 5, 1980 | [JP] | Japan | 55-155654 |
| Nov. 5, 1980 | [JP] | Japan | 55-155655 |
| Nov. 5, 1980 | [JP] | Japan | 55-155656 |
| Nov. 5, 1980 | [JP] | Japan | 55-155657 |

[51] Int. Cl.[3] ..... H01Q 3/22; H01Q 3/24; H01Q 3/26

[52] U.S. Cl. ..... 343/372; 343/375; 343/782

[58] Field of Search ..... 343/371, 375, 376, 446, 343/754, 854, 370, 840, 782, 432, 434

[56] References Cited

U.S. PATENT DOCUMENTS

| | | | |
|---|---|---|---|
| 3,071,770 | 1/1963 | Wilkes | 343/840 X |
| 3,245,081 | 4/1966 | McFarland | 343/375 X |
| 3,445,850 | 5/1969 | Stegen | 343/754 X |
| 3,604,010 | 9/1971 | Schwartz | 343/840 X |
| 3,775,769 | 11/1973 | Heeren et al. | 343/754 X |
| 4,166,274 | 8/1979 | Reudink | 343/376 |
| 4,272,770 | 6/1981 | Miller et al. | 343/782 |

FOREIGN PATENT DOCUMENTS 65-41045 10/1980 Japan .

*Primary Examiner*—Theodore M. Blum
*Assistant Examiner*—Brian Steinberger
*Attorney, Agent, or Firm*—Wenderoth, Lind & Ponack

[57] ABSTRACT

An antenna system includes a reflector and a primary and a subsidiary array antenna which are disposed in front of an aperture of the reflector so as to be positioned back-to-back with each other. An electric power which is supplied to the primary array antenna is also partly supplied to the subsidiary array antenna after it has been controlled in both phase and amplitude in order that a radiant beam from the subsidiary array antenna compensates for that portion of a secondary radiant beam from the reflector which is blocked by the primary array antenna. For example, a transmission source is connected to the primary array antenna through a coupler and a distributor while the coupler is connected to the subsidiary array antenna through a phase and an amplitude regulator and a distributor. The source may also be connected via the distributor to the primary array antenna formed of a plurality of radiating elements which are respectively connected to corresponding radiating elements of the subsidiary array antenna through couplers and delay lines or feeder lines.

12 Claims, 27 Drawing Figures

ANTENNA SYSTEM

BACKGROUND OF THE INVENTION

This invention relates to improvements in an antenna system including a primary radiator and a reflector.

A conventional antenna system of the type referred to has comprised a parabolic cylinder-shaped reflector and a primary radiator including an array antenna disposed in front of an aperture of the reflector so as to direct a primary radiation pattern to the reflector which, in turn reflects the primary pattern into the desired direction as a secondary radiation pattern. Because of the presence of the radiator in front of the aperture of the reflector, the radiator shades or blocks the central portion of the aperture on the longitudinal axis or in the vertical direction so that the secondary radiation pattern in the horizontal plane has its major lobe decreased in field intensity or level and has its first side lobes increased in field intensity.

With such an antenna system used as a radar antenna, it is apt to be affected by clutter such as ground reflections.

Accordingly, it is an object of the present invention to provide a new and improved antenna system comprising a reflector, a primary radiator including an array antenna disposed in front of an aperture of the reflector, and a means for minimizing or substantially eliminating the influence of the blocking by the radiator on a secondary radiation pattern from the reflector.

SUMMARY OF THE INVENTION

The present invention provides an antenna system comprising a reflector, a primary radiator positioned in front of an aperture of the reflector so as to block one portion of the aperture of the reflector, a transmission source, a subsidiary radiator which is substantially equal in its dimensions to an aperture of the primary radiator and which is disposed back-to-back with respect to the primary radiator, a coupler means for supplying one portion of an electric power output from the transmission source to the subsidiary radiator, and a regulation means for causing a secondary radiation pattern from the reflector to coincide in phase with a radiation pattern from the subsidiary radiator and for regulating a field intensity from the subsidiary radiator so as to compensate for an influence of the blocking by the primary radiator.

Preferably, the primary radiator may comprise a feeding array antenna including a plurality of radiating elements, and the subsidiary radiator may comprise a subsidiary array antenna including a plurality of radiating elements which are respectively connected to associated ones of the radiating elements in the feeding array antenna through couplers and delay lines.

BRIEF DESCRIPTION OF THE DRAWINGS

The present invention will become more readily apparent from the following detailed description taken in conjunction with the accompanying drawings in which.

Throughout the drawing figures, like reference numerals designate the identical or corresponding components.

DESCRIPTION OF THE PREFERRED EMBODIMENTS

Figure 1:
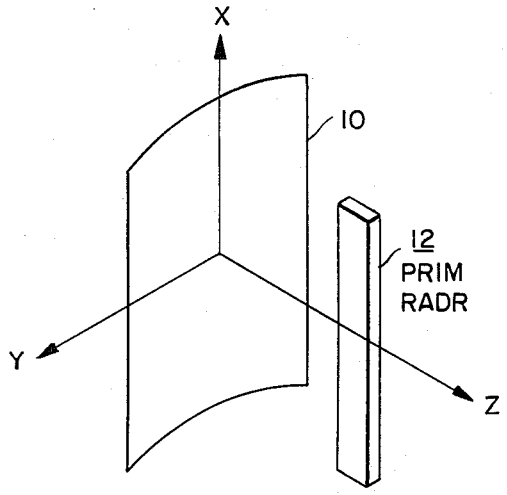
FIG. 1. (PRIOR ART)
FIG. 1 is a schematic perspective view of a conventional reflector antenna system.
Figure 2:
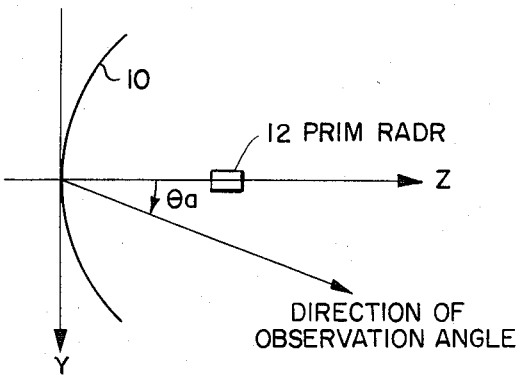
FIG. 2. (PRIOR ART)
FIG. 2 is a plan view of the arrangement shown in FIG. 1 as viewed in the horizontal plane thereof.

Referring now to FIGS. 1 and 2 of the drawings, there is illustrated a conventional reflector antenna system. The illustrated arrangement comprises a reflector 10 in the form of a parabolic cylinder having its longitudinal axis shown as extending vertically or along the x axis of a three-dimensional orthogonal coordinate system having its origin lying at a vertex of the central cross-sectional profile of the reflector 10 and a primary radiator generally designated by the reference numeral 12. The primary radiator 12 is in the form of a rectangular parallelopiped extending along the longitudinal axis of the parabolic cylinder and positioned in front of an aperture of the parabolic cylinder-shaped reflector 10 with its longitudinal axis parallel to the x axis and lying in the horizontal plane or the x-z plane of the coordinate system. Also, the radiator 12 has its central transversal axis extending through the longer width thereof along the z axis of the coordinate system.

FIG. 2 is a plan view of the arrangement shown in FIG. 1 as viewed in the horizontal plane thereof or the y-z plane of the coordinate system.

In the arrangement shown in FIGS. 1 and 2, the primary radiator 12 is positioned in front of the aperture of the reflector 10 as described above so that the radiator 12 shades or blocks the central portion of the aperture in the vertical direction or the direction of the x axis of the coordinate system. The radiator 12 radiates a primary radiation pattern toward the reflector 10 which, in turn, reflects the primary radiation pattern into space as a secondary radiation pattern. At that time, the radiator 12 shades or blocks partly the secondary radiation pattern in the direction of the x axis which will now be described in conjunction with FIGS. 3A, 3B and 3C wherein the ordinate axis represents a radiation field intensity in the horizontal plane or the y-z plane of the coordinate system and the abscissas axis represents an aximuth $\theta_a$ measured from the z axis. In FIG. 2, a line labelled "DIRECTION OF OBSERVATION ANGLE" forms an angle $\theta_a$ with the z axis and indicates a typical direction in which the radiation field intensity is observed.

Figure 3A:
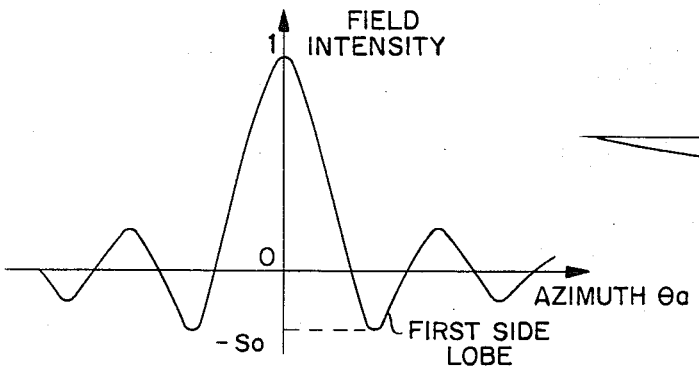
FIG. 3A. (PRIOR ART)
FIGS. 3A, 3B and 3C are graphs useful in explaining the influence of the primary radiator shown in FIGS. 1 and 2 upon a horizontal secondary radiation pattern from the reflector shown in FIGS. 1 and 2.

FIG. 3A shows a horizontal radiation pattern in the absence of the blocking by the radiator and having a major lobe having a field intensity designated by 1 and a plurality of side lobes among which each of two first side lobes having a maximum intensity designated by $S_0$.

Figure 3B:
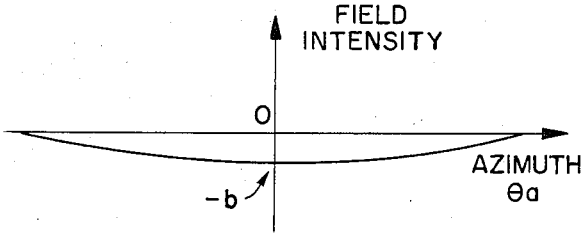
FIG. 3B. (PRIOR ART)

FIG. 3B shows that portion of the horizontal radiation pattern shaded or blocked by the primary radiator 12 and having a negative intensity designated by $-b$ where $0<b<1$ because it is a shaded radiation pattern. As shown in FIG. 2, the primary radiator 12 has a width in the horizontal plane which is narrow as compared with the aperture of the reflector 10 and therefore the shaded radiation pattern is broad in width and low in intensity.

Figure 3C:
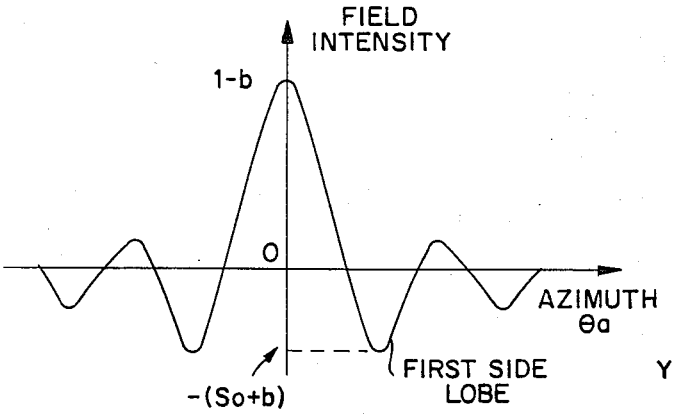
FIG. 3C. (PRIOR ART)

In the arrangement of FIG. 2 comprising the primary radiator 12, a secondary radiation pattern in the horizontal plane from the reflector 10 results in the radiation pattern as shown in FIG. 3A superposed on that shown in FIG. 3B as illustrated in FIG. 3C. In FIG. 3C it is seen that the major lobe and the even-numbered side lobes are decreased in intensity whereas the odd-numbered side lobes are increase in intensity. Apart from the major lobe, the first side lobes having the highest intensity S expressed by $$S_1 = \frac{S_{0+b}}{1-b} \quad (1)$$

Since $0<b<1$ as described above, it is apparent that the secondary radiation pattern as shown in FIG. 3C has a higher first side lobe intensity than the primary radiator pattern illustrated in FIG. 3A.

From the foregoing it is seen that the secondary radiation pattern from the reflector 10 which is partly blocked by the radiator 12 has its odd-numbered side lobes increased in intensity. Therefore, if antenna systems such as shown in FIGS. 1 and 2 are used as radar antennas, then they are apt to be affected by clutter such as ground reflections. This has resulted in much deterioration of the function of the radar apparatus used with such antennas.

The present invention contemplates the elimination of the disadvantages of the prior art practice by the provision of an antenna system comprising a reflector, a primary radiator positioned in front of an aperture of the reflector so as to block one portion of the aperture, and a transmission source, wherein a subsidiary radiator is provided which is positioned back-to-back with respect to the primary radiator and wherein an output signal from the transmission source is partly fed to the subsidiary radiator through a coupler means so that a radiation pattern from the subsidiary radiator compensates for that portion of a secondary radiation pattern from the reflector which is blocked by the primary radiator.

Figure 4:
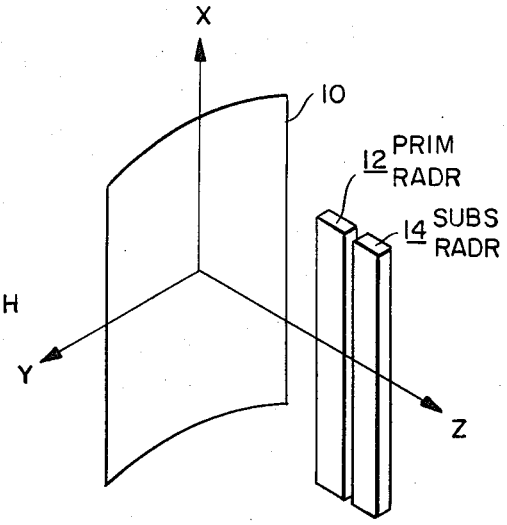
FIG. 4 is a schematic perspective view of one embodiment according to the reflector antenna system of the present invention.
Figure 5:
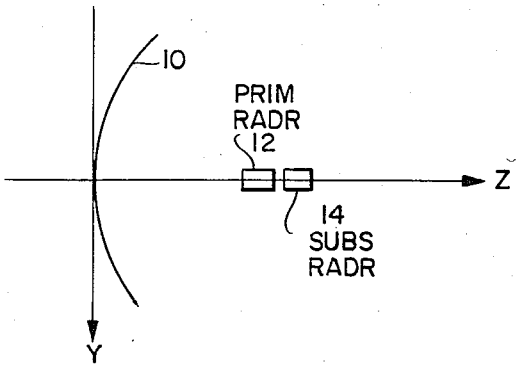
FIG. 5 is a plan view of the arrangement shown in FIG. 4 as viewed in the horizontal plane thereof.

Referring now to FIGS. 4 and 5, there is illustrated one embodiment according to the antenna system of the present invention and having a three-dimensional orthogonal coordinate system which is identical to that shown in FIG. 1. The illustrated arrangement comprises, in addition to the reflector 10 and the primary radiator 12 as described above in conjunction with FIGS. 1 and 2, and a subsidiary radiator generally which is designated by the reference numeral 14 and which is positioned back-to-back with respect to the primary radiator 12 with a small gap formed therebetween. The subsidiary radiator 14 is aligned with the primary radiator 12 in the direction of the z axis of the coordinate system and has its width along the y axis thereof equal to that of the primary radiator 12 as shown in FIG. 4. Therefore, the two radiators 12 and 14 are substantially equal in their aperture dimensions.

Figure 6:
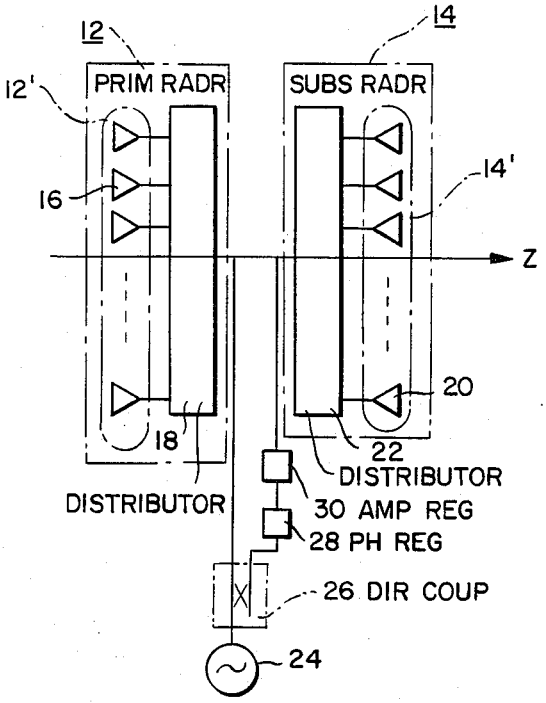
FIG. 6 is a block diagram of the details of the primary and subsidiary radiators shown in FIGS. 4 and 5 along with an associated circuit.

The primary and subsidiary radiators 12 and 14 respectively have circuit configurations as shown in FIG. 6. More specifically, the primary radiator 12 includes a feeding array antenna which is generally designated by the reference numeral 12' and which consists of a plurality of radiating elements 16 connected to a distributor circuit 18; the subsidiary radiator 14 includes a subsidiary array antenna which is generally designated by the reference numeral 14' and which consists of a plurality of a radiating elements 20 connected to a distributor circuit 22. A transmission source 24 is connected to a directional coupler 26 which is, in turn, connected to the distributor circuit 18 on the one hand and to the distributor circuit 22 through a series combination of a phase regulator 28 and an amplitude regulator 30 on the other hand.

The operation of the arrangement shown in FIGS. 4, 5 and 6 will now be described. An output signal from the transmission source 24 is supplied to the distributor circuit 18 through the directive coupler 26 and then radiated, as a primary radiation pattern, toward the reflector 10 by the feeding array antenna 12'. The output signal thus radiated is reflected from the parabolic cylinder-shaped reflector 10 to form a secondary radiation pattern.

On the other hand, the output signal from the directional coupler 26 passes partly through the phase regulator 28 and the amplitude regulator 30 until it is supplied to the distributor circuit 22. The output signal from the distributor circuit 22 is radiated into space through the respective radiating elements 20 to form another primary radiation pattern.

Since the subsidiary radiator 14 has a width along the Y axis of the coordinate system which is substantially equal to that of the primary radiator 12 as described above, the radiation pattern from the subsidiary radiator 14 in the horizontal plane of the subsidiary array antenna 14 has a broad width comparable to that shown in FIG. 3B. In addition, by respectively regulating the phase and amplitude of the output signal from the directional coupler 26 by the phase and amplitude regulators 28 and 30, the radiation pattern from the subsidiary radiator 14 can form a mirror image of that shown in FIG. 3B with respect to the abscissas axis thereof. In other words, the radiation pattern has a positive intensity b in its front direction.

Therefore, it is apparent that, by superposing the radiation pattern from the subsidiary radiator 14 on that from the reflector 10 as shown in FIG. 3C, the shaded radiation pattern shown in FIG. 3B is cancelled out by the radiation pattern from the subsidiary radiator 14, resulting in the appearance of the original radiation pattern, as shown in FIG. 3A, free from the influence of the blocking by the primary radiator 12. Accordingly, the resultant radiation pattern includes the major lobe and side lobes having the original field intensities returned back from their magnitudes being lowered or raised due to the blocking by the primary radiator 12.

Figure 7:
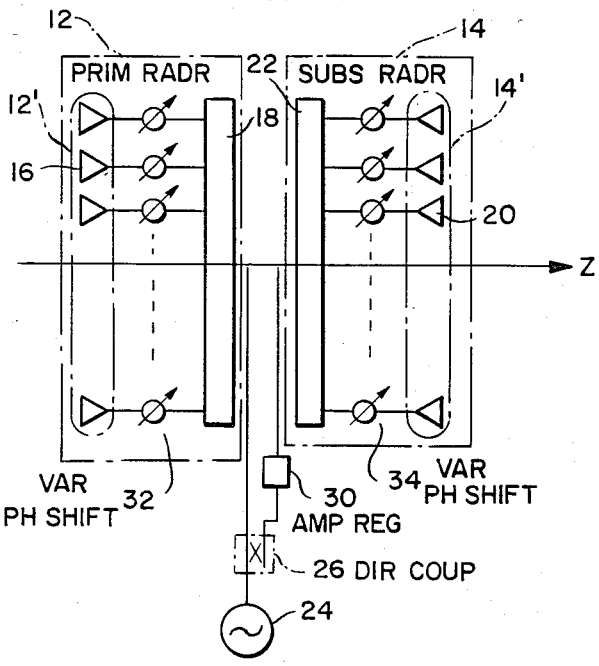
FIG. 7 is a diagram similar to FIG. 6 but illustrating a modification of the arrangement shown in FIG. 6.

FIG. 7 illustrates a modification of the arrangement shown in FIG. 6. The illustrated arrangement is different from that shown in FIG. 6 only in that in FIG. 7 each of the feeding radiating elements 16 is connected to the distributor circuit 18 through its own variable phase shifter 32 and each of the subsidiary radiating elements 20 is similarly connected to the distributor circuit 22 through its own variable phase shifter 34 with the phase regulator 28 omitted.

Thus, each of the primary and subsidiary radiators 12 and 14 respectively forms the so-called phased array antenna in which the mating variable phase shifters 32 or 34 are controlled to change phases at which the associated radiating elements 16 or 20 are excited so as to thereby effect the beam scanning electronically. Under these circumstances, the antenna system including the primary radiator 12 and the parabolic cylinder-shaped reflector 10 forms what electronically effects the beam scanning. It will readily be understood that, for each beam scanning, the radiation pattern from the subsidiary radiator 14 effectively cancels out the adverse influence of the blocking by the primary radiator 12.

It is noted that the variable phase shifters 34 function to compensate for a change in relative phase between the primary and subsidiary radiators 12 and 14 which are respectively varied for each beam scanning angle.

Figure 8:
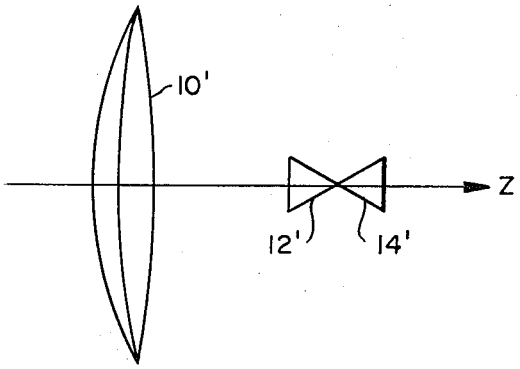
FIG. 8 is a plan view, partly in perspective of a modification of the arrangement shown in FIGS. 4 and 5.

FIG. 8 shows another modification of the arrangement shown in FIGS. 5 and 6. In the illustrated arrangement, illustrated a paraboloidal reflector 10 is substituted for the parabolic cylinder-shaped reflector and the primary and subsidiary radiators 12 and 14 are formed of a pair of horn antennas also designated by the reference numerals 12' and 14'. The horn antennas 12' and 14' are positioned back-to-back with respect to each other with the longitudinal axes thereof lying on the z axis of the coordinate system.

Figure 9:
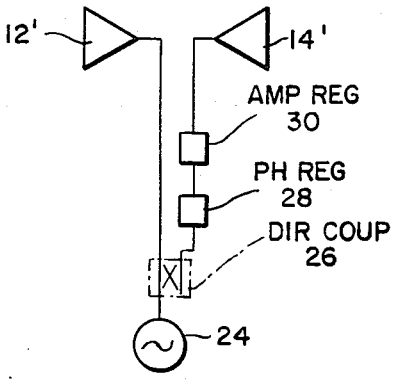
FIG. 9 is a block diagram of an antenna feeding circuit for the arrangement shown in FIG. 8.

As shown in FIG. 9, the horn antennas 12' and 14' are supplied with the output signal from an antenna feeding circuit which is identical to that shown in FIG. 6.

It will readily be understood that the arrangement shown in FIGS. 8 and 9 is substantially identical in operation to that illustrated in FIGS. 5 and 6.

Figure 10:
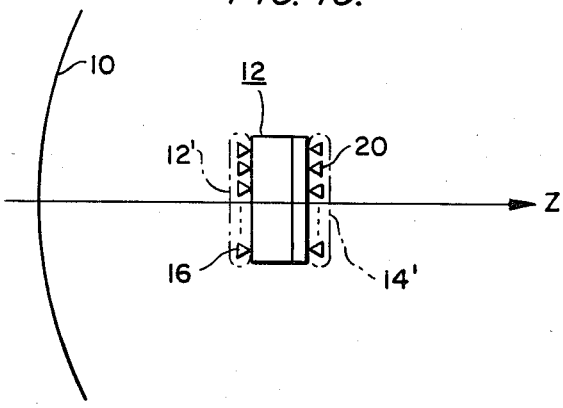
FIG. 10 is a plan view of a modification of the present invention.
Figure 11:
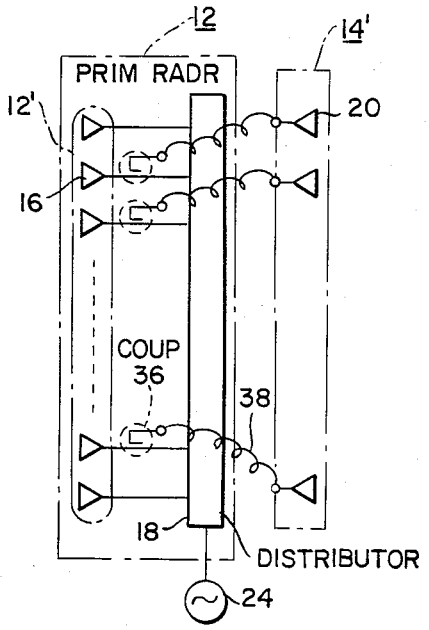
FIG. 11 is a block diagram of the details of the primary and subsidiary radiators shown in FIG. 10 and an antenna feeding circuit connected thereto.

FIGS. 10 and 11 show another modification of the present invention. In the illustrated arrangement, the subsidiary radiator 14 includes only the subsidiary array antenna 14' consisting of a plurality of radiating elements 20 and is disposed back-to-back with respect to the primary radiator 12. The primary radiator 12 is identical to that shown in FIGS. 5 and 6 excepting that each of the radiating elements 16 is connected to an associated one of the radiating elements 20 in the subsidiary array antenna 14' through a coupler 36 and a delay line 38 except for the uppermost and lowermost radiating elements 16 as viewed in FIG. 11. Thus, the number of subsidiary radiating elements 20 is smaller than that of the primary radiating elements 16. The transmission source 24 is directly connected to the distributor circuit 18 disposed in the primary radiator 12 by omitting the components 22, 26, 28 and 30 shown in FIG. 6.

In other respects, the arrangement is identical to that shown in FIGS. 5 and 6.

In operation, the output signal from the transmission source 24 is distributed to the radiating elements 16 of the feeding array antenna 12' through the distributor circuit 18 while that portion of the output signal supplied to each of the radiating elements 16 is partly supplied to an associated one of the radiating elements 20 in the subsidiary array antenna 14' through the mating coupler 36 and delay line 38 except for the uppermost and lowermost ones as described above.

Figure 12:
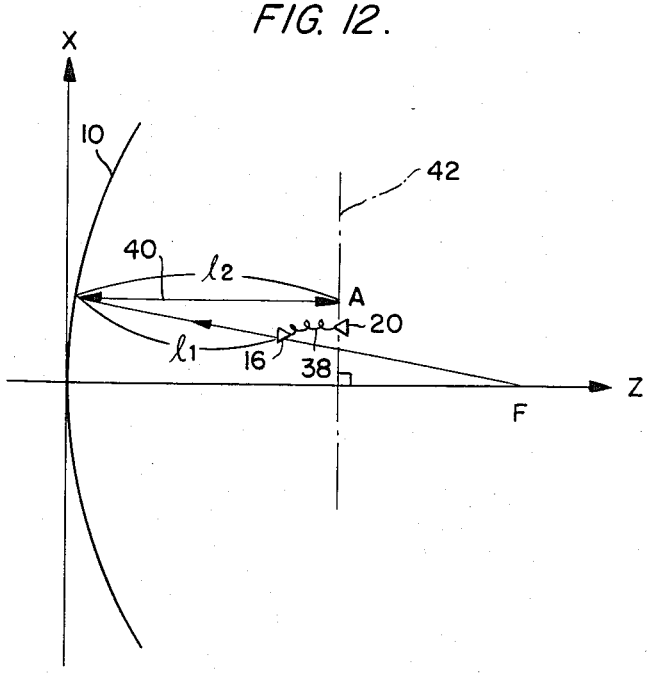
FIG. 12 is a schematic cross sectional view of the arrangement shown in FIG. 10 useful in explaining how a length of the delay line shown in FIG. 11 is determined.

In order to maintain the desired phase relationship between the primary and subsidiary array antennas 12' and 14', the length of the delay line 38 should be properly determined. This will now be described with reference to FIG. 12 wherein there is illustrated a schematic cross-section of the arrangement shown in FIGS. 10 and 12 as viewed in the x-z plane of a three-dimensional orthogonal coordinate system such as shown in FIG. 1. Accordingly, a single one of the primary radiating elements 16 and an associated one of the subsidiary radiating elements 20 lie in the x-z plane and are shown as being connected to each other only through their corresponding delay line 38 with the associated coupler 36 omitted.

It is now assumed that a radiant beam from the primary radiating element 16 is radiated along an extension of a line passing through that antenna 16 and the focus F of the parabola 10. The radiant beam is reflected from the reflector 10 to travel, as a reflected beam 40, in parallel to the axis of the parabola or the z axis until the reflected beam 40 intersects at a point A, the perpendicular 40 from the subsidiary radiating element 20 drawn to the z axis in the x-z plane. Also assume that l designates a length of an optical path along which the radiant beam departs from the radiating element 16 and then is reflected from the reflector 10 until it reaches the point A. The length l may be expressed by $$l = l_1 + l_2 \qquad (2)$$

where $l_1$ designates a length of the optical path between the radiating element 16 and a point on the reflector 10 from which the reflected beam 40 is reflected and $l_2$ designates a length of the optical path along which the reflected beam 40 from the reflector 10 travels to reach the point A.

Then, the length $l_d$ of the delay line 38 is selected to be equal to an electrical length corresponding to the length l of the optical path expressed by the expression (2). In other words, the length $l_d$ is determined to satisfy the equation:

$$\frac{2\pi}{\lambda_g} l_d = \frac{2\pi}{\lambda} l \quad (3)$$

where $\lambda$ designates a free space wavelength and $\lambda_g$ designates a line wavelength on the delay line.

This determination of the length $l_d$ permits the subsidiary radiating element 20 to restore a secondary wave source with a phase identical to that excepted to be originally possessed thereby at the point A where that source ought to exist but has disappeared due to the blocking. Also, no frequency characteristic is developed in the correction of the phase as described because the delay line has a length corresponding to that of the optical path.

The selections of the length of the delay line as described above is repeated with all the delay lines 38.

From the foregoing it is seen that the arrangement shown in FIGS. 10 and 11 can eliminate the adverse influence of the blocking by the primary array antenna 12' over a wide band by the subsidiary array antenna 14' whereby the increase of the side lobes shown in FIG. 3C can be lowered to their original magnitudes.

Figure 13:
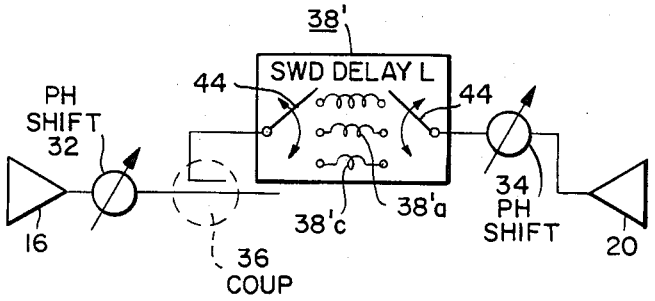
FIG. 13 is a combined block and circuit diagram of a modification of the arrangement shown in FIG. 10 with the omission of the parabolic cylinder-shaped reflector shown in FIG. 10.

FIG. 13 shows a modification of the arrangement shown in FIGS. 10 and 11 but illustrates only a single one of the radiating elements 16 in the primary array antenna connected to its corresponding radiating element 20 in the subsidiary array antenna through a modified delay line. In the arrangement illustrated arrangement, the radiating element 16 is connected to a switched delay line 38' through a series combination of a variable phase shifter 32 and a coupler 36 while the switched delay line 38' is connected to its corresponding radiating element 20 through a variable phase shifter 34. The switched delay line 38' includes a plurality of delay lines, in this case, three delay lines 38'*a*, 38'*b* and 38'*c*, which are different in length from one another, and a pair of switches 44, each having a movable arm, are selectively engaged at one end by one or the other of the ends of delay lines 38'*a*, 38'*b* and 38'*c* and are connected at the other end thereof to the coupler 36 or to the variable phase shifter 34.

When the arrangement of FIG. 13 is applied to that shown in FIGS. 10 and 11, the resulting reflector antenna system can electronically effect the beam scanning because of the presence of the variable phase shifters 32 connected to the feeding array antenna. However, the reflected beam 40 shown in FIG. 12 varies in direction for each of the beam scanning angles resulting in a change in length l of the optical path. Therefore, it is recalled that the arrangement of FIG. 13 includes three delay lines 38'*a*, 38'*b* and 38'*c* having different lengths. Each of those delay lines is prepared for a different one of the lengths of the optical path resulting from the beam scanning angle. The different delay lines are selectively connected between the radiating elements 16 and 20 through the operation of the switches 44 as determined by the particular beam scanning angle.

The purpose of each of the variable phase shifters 34 is to change the relative phases between its corresponding subsidiary radiating element 20 and its adjacent element 20 in order to control the direction of the beam from the subsidiary array antenna 14'.

It will readily be understood that, with the arrangement of FIG. 10 modified to utilize the circuit configuration as shown in FIG. 13 for the purpose of effecting electronically the beam scanning, the increase of the side lobes due to the blocking over a wide band for each of the beam scanning agles can be avoided.

Furthermore, with the arrangement of FIG. 13 substituted for that shown in FIG. 11, the omission of the variable phase shifters 34 makes it possible to effect the beam scanning in the manner as will subsequently be described. A change in phase effected by each of the variable phase shifter 32 is transmitted via its corresponding coupler 36 and variable delay line 38 to the associated subsidiary radiating element 20. However, the use of this change in phase as it is results in a radiant beam from the subsidiary array antenna 14' not generally coinciding in direction with that formed by reflecting a radiant beam from the primary array antenna 12' by the reflector 10. In this case, the beam from the subsidiary array antenna 14' can coincide in direction with that resulting from the primary array antenna 12' by properly selecting both intervals at which the radiating elements 16 are arranged in the primary array antenna 12' and intervals at which the radiating antennas 26 are arranged in the subsidiary array antenna 14'. This measure can also eliminate the adverse influence of the blocking by the primary radiator 12.

For use in a relatively narrow band, the variable phase shifter 34 may vary both a change in length of the optical path and a change in beam scanning phase with the switched delay line 38' being omitted.

Figure 14:
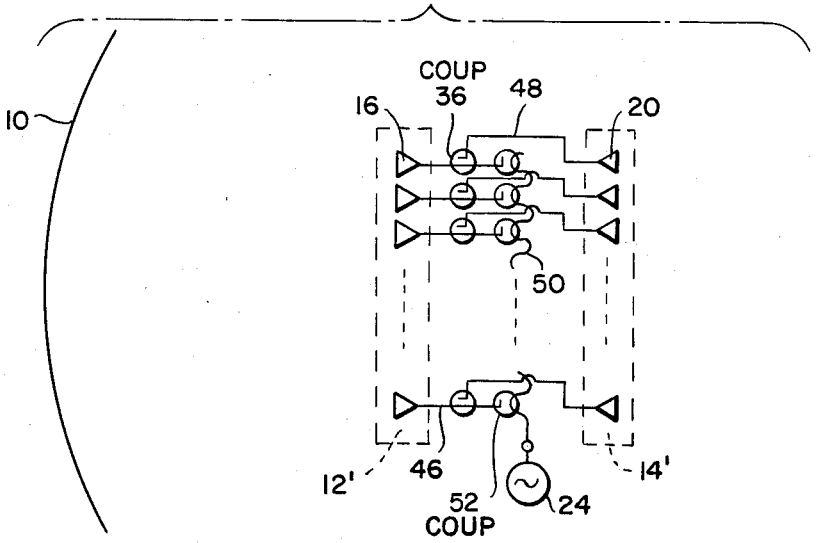
FIG. 14 is a plan view of another modification of the present invention applied to a double frequency-double beam antenna system.

FIG. 14 shows another modification of the present invention applied to a double frequency-double beam antenna system. In the illustrated arrangement, the primary array antenna 12' is formed of a plurality of radiating elements 16 which are respectively connected to associated radiating elements 20 through primary feeder lines 46, directional couplers 36 and subsidiary feeder lines 48. These radiating elements 20 form the subsidiary array antenna 14.

The transmission source 24 is connected to a serpentine feeder line 50 having a plurality of couplers 52 connected at predetermined intervals thereto, one for each of the radiating elements 16 or 20. Then, each of the couplers 52 is respectively connected to a different one of the primary feeder lines 46 having the couplers 36 connected therein.

In other respects the arrangement is identical to that shown in FIGS. 4 and 5.

The transmission source 24 delivers an output signal having a pair of different frequecies $f_1$ and $f_2$. During its propagation along the serpentine feeder line 50, the output signal with the frequencies $f_1$ and $f_2$ is successively picked up by the succeeding couplers 52 and then respectively supplied to the respective radiating elements 16 through the couplers 36 and the primary feeder lines 46. The picked-up signal portion directed to the respective radiating elements 16 are partly taken out from the associated couplers 36 and then respectively supplied to the mating radiating elements 20 through the subsidiary feeder lines 48. Thus, the subsidiary array antenna 14 radiates a radiation pattern which is, in turn, superposed on a secondary radiation pattern from the reflector 10 resulting from the feeding array antenna 14'.

By properly selecting the length of the subsidiary feeder lines 48, the radiation patterns from the reflector 10 and the subsidiary array antenna 14' can superpose each other with the same phase.

Under these circumstances, the signal portion with the frequencies $f_1$ and $f_2$ is supplied via its corresponding coupler and subsidiary feeder line 36 and 48 to that subsidiary radiating element 20 connected thereto so that the signal portion has relative phase difference with respect to that supplied to the adjacent radiating elements 20 which is different between the frequencies $f_1$ and $f_2$. Thus, the subsidiary array antenna 14' radiates a pair of radiant beams. Those radiant beams should coincide in direction with a pair of secondary radiant beams radiated from the reflector 10. Otherwise, the subsidiary array antenna 14' can not eliminate the adverse influence of the blocking by the primary array antenna 12'.

The arrangement of FIG. 14 has encountered a problem in that a phase difference is developed between the pair of secondary radiant beams having the frequencies $f_1$ and $f_2$ which are reflected from the reflector 10. This is attributed to the optical properties as determined by the shape of the reflector 10 and the primary array antenna and a relative position therebetween. For example, even if a variable phase shifter is connected in each of the primary feeder lines, it is impossible to form a phase difference between the pair of radiant beams from the subsidiary array antenna from which each pair of adjacent subsidiary radiating elements are excited. This is because the phase at the frequency $f_1$ can not be controlled independently of that at the frequency $f_2$.

Figure 15:
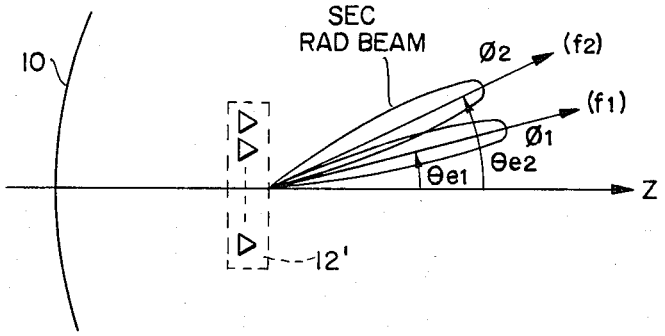
FIG. 15 is a plan view of a double frequency-double beam antenna system in which the present invention is interested.

The arrangement of FIG. 14 can be modified to solve the problem as described above. Before such a modification will be described, the pair of secondary radiant beams from the parabolic cylinder-shaped radiator 10 will now be described in conjunction with FIG. 15 wherein there are illustrated a pair of secondary radiant beams. Those secondary radiant beams have the frequencies $f_1$ and $f_2$ and angles of elevation $\theta_{e1}$ and $\theta_{e2}$ respectively. Also electric radiation fields have respective phase $\phi_1$ and $\phi_2$ at the angles of elevation $\theta_{e1}$ and $\theta_{e2}$. Assuming that the frequency $f_2$ is higher than the frequency $f_1$, the signal portion with the frequency $f_2$ propagates along the serpentine feeder line 50 shown in FIG. 15 with a phase lag which is larger than that of the signal portion with the frequency $f_1$ due to the frequency characteristic of the propagation phase constant thereof. Thus, the beam $\phi_2$ with the frequency $f_2$ is shown in FIG. 15 as being radiated at the angle of elevation which is larger than that of the beam $\phi_1$ with the frequency $f_1$.

Figure 16:
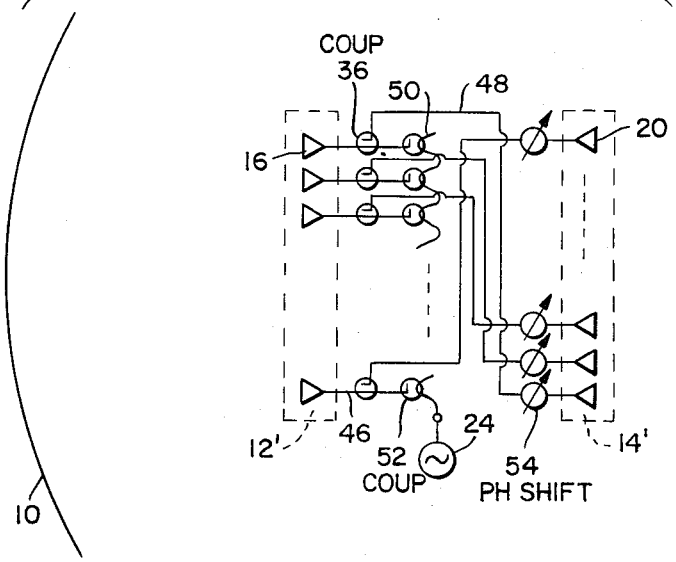
FIG. 16 is a view similar to FIG. 14 but illustrating a modification of the arrangement shown in FIG. 14.

FIG. 16 shows the abovementioned modification of the arrangement shown in FIG. 14. The illustrated arrangement is different from that shown in FIG. 14 only in that in FIG. 16, the primary radiating elements 16 are respectively coupled in cross-cross connection arrangement to the subsidiary radiating elements 20 through the couplers 36, the subsidiary feeder lines 48 and variable phase shifters 54. For example, the uppermost radiating element 16 in the primary array antenna 12' is connected to the lowermost antenna 20 of the subsidiary array antenna 14' in the manner as described above. Also, the primary radiating elements antenna element 16 next to the uppermost antenna element 16 is similarly connected to the penultimate radiating element 20 in the subsidiary array antenna 14'.

Therefore, the transmission source 24 supplies the output signal to the feeding array antenna 12' in an upside down (i.e.—reverse) relationship with respect to the subsidiary array antenna 14'. As a result, the subsidiary array antenna 14' radiates the beam $\phi_1$ with the frequency $f_1$ at an angle of elevation which is larger than that of the beams $\phi_2$ with the frequency $f_2$ which is upside down with respect to the illustration of FIG. 15.

The purpose of the variable phase shifters 54 is to compose the so-called double beam pattern in which a pair of beams are developed, from a signal having a single frequency as a radiation pattern from the subsidiary array antenna 14'. It is generally possible to selectively compose radiation patterns in the form of various shapes by controlling exciting amplitudes and phases of radiating elements forming an array antenna according to conventional antenna techniques. In this case, it is most desirable to permit both the amplitudes and phases to be variably controlled but it is possible to compose a radiation pattern which is sufficiently put to practical use by variably controlling only the phase with the amplitudes maintained fixed.

Figure 17:
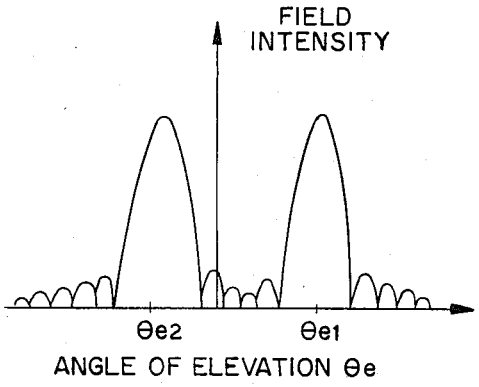
FIG. 17 is a graph illustrating a double beam pattern resulting from the arrangement shown in FIG. 16.

FIG. 17 shows, by way of example, a radiation pattern composed of a pair of radiant beams radiated at angles of elevation $\theta_1$ and $\theta_2$. In FIG. 17, a radiation field intensity is plotted on the ordinate against an angle of elevation $\theta_e$ plotted on the abscissa. It is possible to change a relative phase of the major lobe of one to the other of the two radiant beams at will according to conventional techniques of composing the directivity of an array antenna.

Figure 18:
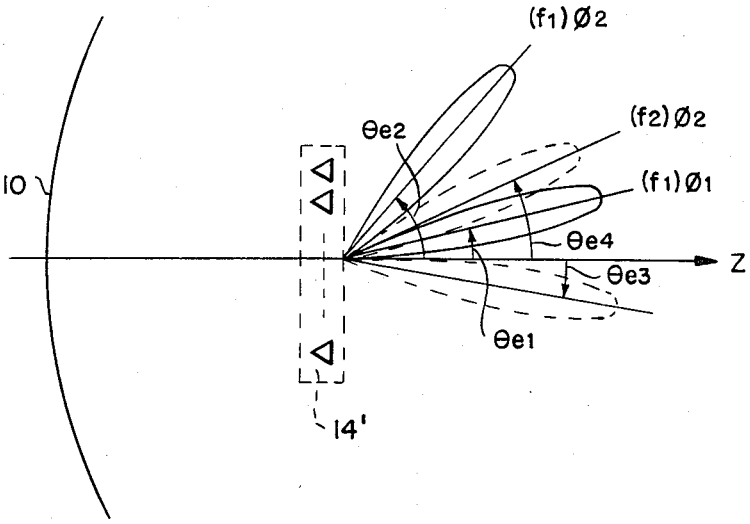
FIG. 18 is a diagram illustrating a double frequency-quadruple beam obtained by the arrangement shown in FIG. 16.

FIG. 18 is a view which is similar to FIG. 15 but illustrating a radiation pattern from the subsidiary array antenna of the present invention arranged to compose a double beam pattern for a single frequency according to the phase control just described. As shown by the solid lines in FIG. 18, two beams with the frequencies $f_1$ and $f_2$ are radiated at angles of elevation $\theta_{e1}$ and $\theta_{e2}$ and relative phases $\theta_1$ and $\theta_2$ are imparted to radiation fields corresponding to the two beams. This is because the variable phase shifters 54 (see FIG. 16) have phases set to cause the subsidiary array antenna 14' to radiate beams at the angles of elevation $\theta_{e1}$ and $\theta_{e2}$ for the frequency $f_1$. At that time, the arrangement of FIG. 16 is operated to cause the subsidiary array antenna 14' to radiate a pair of beams with the frequency $f_2$ at angles of elevation $\theta_{e3}$ and $\theta_{e4}$ which are respectively smaller than those labelled $\theta_{e1}$ and $\theta_{e2}$ as shown by the dotted lines in FIG. 18. That is, the pair of radiant beams with the frequency $f_2$ are formed by turning those beams with the frequency $f_1$ downwardly in the clockwise direction as viewed in FIG. 18 so as to respectively change the angles of elevation from $\theta_{e1}$ and $\theta_{e2}$ to $\theta_{e3}$ and $\theta_{e4}$. This turning results from the effect of the antenna feeding through the criss-crossed connection as described above in conjunction with FIG. 16. The variable phase shifter 54 has no frequency characteristic presented before the frequencies $f_1$ and $f_2$ and therefore the relative phases $\phi_1$ and $\phi_2$ are retained at the frequency $f_2$.

By properly selecting both the phase difference due to the frequencies $f_1$ and $f_2$ and the intervals at which the radiating elements 20 are arranged in the subsidiary array antenna 14', the latter radiates the two beams at the angles of elevation $\theta_{e3}$ and $\theta_{e4}$ for the frequency $f_2$ as shown in FIG. 18. In other words, the subsidiary array antenna 14' generates four radiant beams, two for each of the frequencies $f_1$ or $f_2$.

Among the four beams, the radiant beams in the directions $\theta_1$ and $\theta_3$ with the frequencies $f_1$ and $f_2$ which are radiated at the angles of elevation $\theta_{e1}$ and $\theta_{e2}$ as shown in FIG. 18 are respectively superposed on the two radiant beams as shown in FIG. 15 with the same phase. In other words, that portion of the secondary radiant beam from the reflector 10 which are absent due to the primary array antenna 12' can be restored by the beams at the angles of elevations $\theta_{e1}$ and $\theta_{e4}$ from the subsidiary array antenna 14'. This results in the initial radiation pattern having good characteristics and free from the blocking.

The subsidiary array antenna is used to form a pair of radiant beams for a single frequency and cancel out the influence of the blocking with only one of the beams. Therefore, the remaining beam is unnecessarily formed, resulting in a loss of an antenna gain by 3 dB or one half as compared with an assumed case where the subsidiary array antenna forms only a single beam. However, this loss in the antenna gain has a small influence in view of practical use for the following reasons: An area blocked by the feeding array antenna is generally so small as to be only a few percent as compared with an aperture area of the reflector 10. Thus, it is only necessary to impart an intensity to the radiant beam from the subsidiary array antenna which is sufficiently less than that of the secondary radiant beam from the reflector 10 caused from the primary array antenna. This results in the possibility of leaving the beams at the angles of elevation $\theta_{e2}$ and $\theta_{e3}$ shown in FIG. 18 as side lobes of the resulting radiation pattern formed of the composition of the secondary radiation pattern and the radiation pattern from the subsidiary array antenna. However such side lobes are low in intensity.

It is noted that the coupler 36 has a coupling ratio as determined in accordance with an intensity of a radiation field required for the subsidiary array antenna and which is, in turn, determined by a ratio at which the aperture of the reflector is blocked by the radiator the feeding array antenna.

Figure 19:
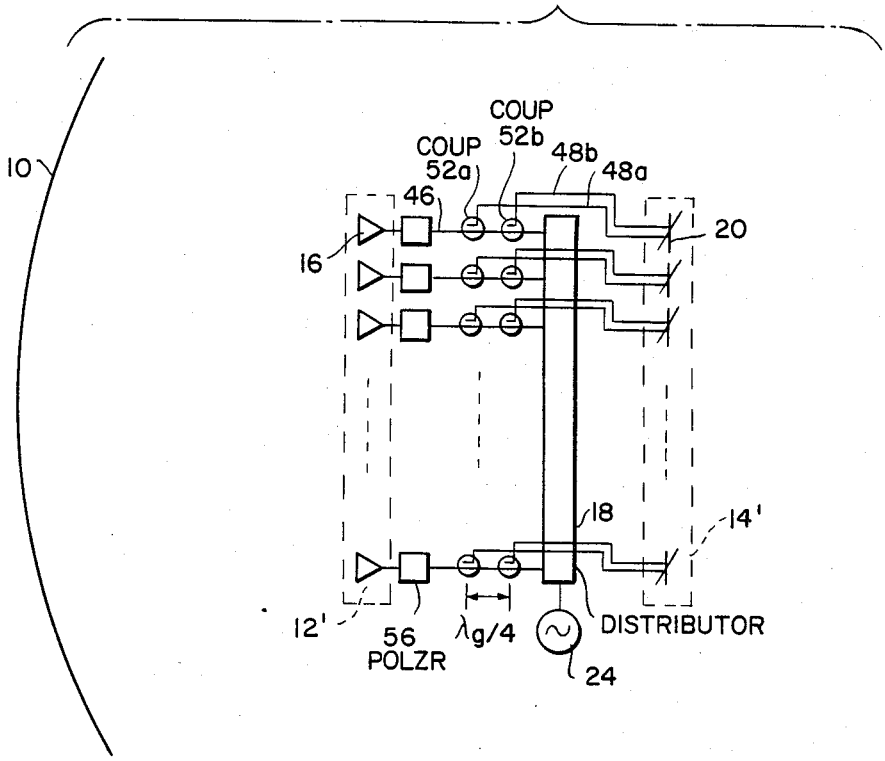
FIG. 19 is a plan view of still another modification of the present invention applied to an antenna system for radiating a circularly polarized wave.

FIG. 19 shows still another modification of the present invention applied to an antenna system for radiating a circularly polarized wave. In the illustrated arrangement, the primary array antenna 12' is formed of a plurality of conical horns 20 serving as the radiating elements and respectively connected in a parallel circuit relationship to the distributor circuit 18 in the form of a waveguide through a polarizer 56 and sections of a primary waveguide 46, the distributor circuit 18 also being connected to the transmission source 24. Each section of the primary waveguide 46 has a pair of couplers **52*a* and 52*b* disposed thereon at an interval of a quarter of an wavelength $\lambda_g$ with which an output signal from the transmission source 24** propagates along the same. If desired, the interval may be equal to any of odd multiples of a quarter of the wavelength $\lambda_g$. That is, the interval d may be expressed by $$d = \lambda_g\left(\tfrac{1}{4} + \frac{n}{2}\right)$$

where n designates any integer including a zero.

In each section of the primary waveguide 46, the pair of couplers **52*a* and 52*b* and connected to a pair of coaxial lines 48*a* and 48*b* having equal lengths and connected to a pair of orthogonal dipole antennas of an associated one of crossed dipole antennas 20. The crossed dipole antennas 20 serve as the radiating elements 20 in the subsidiary array antennas 14'**.

In the arrangement of FIG. 19, the conical horns radiate circularly polarized waves because of the presence of the polarizers 56 and the crossed dipole antennas 20 radiate similarly circularly polarized waves because signal portions are taken out in a quadrature relationship from each section of the primary waveguides 46 through the pair of couplers **52*a* and 52*b* and directly supplied to the two dipole antennas forming that crossed dipole antenna 20**.

In other respects, the arrangement of FIG. 19 is substantially similar to that shown in FIG. 14.

Since the pair of couplers **52*a* and 52*b* are connected in each section of the primary waveguide 46, each of the couplers 52*a* or 52*b* is only required to have a coupling ratio equal to one half that of conventional couplers. Therefore, the coupler itself can easily be designed and constructed. Furthermore, since reflections from the couplers 52*a* and 52*b* are cancelled out in the associated section of waveguide 46 due to the fact that their spacing is equal to one quarter of the wavelength $\lambda_g$, an input standing wave ratio imparted to the section of waveguide 46** has little influence.

Also, it is not necessary to connect a 90° hybrid circuit having an insertion loss to the crossed dipole antennas. The coupling of each of the couplers **52*a* or 52*b*** may accordingly be small.

While the pair of coaxial lines **48*a* and 48*b*** have the equal lengths as described above, it is to be understood that they have generally different lengths with different crossed dipole antennas.

Figure 20:
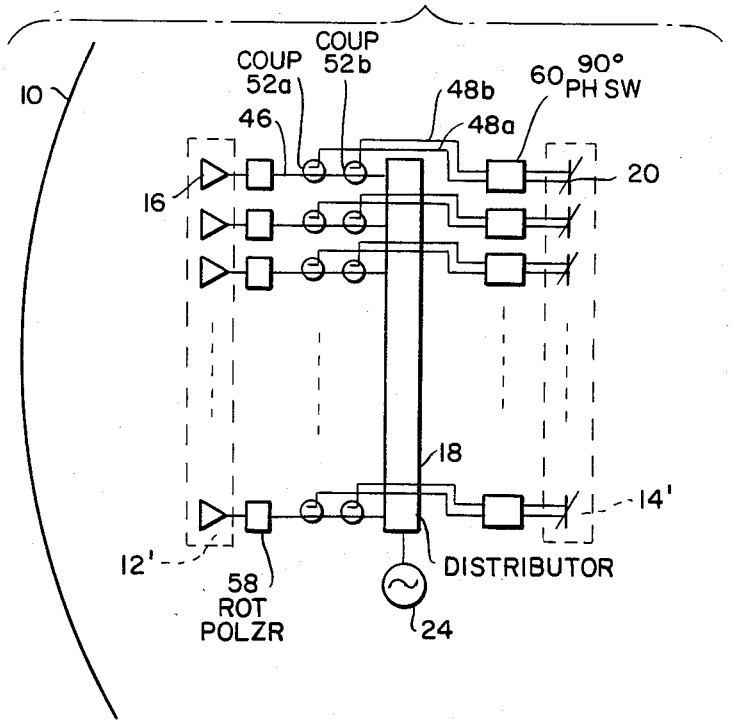
FIG. 20 is a view similar to FIG. 19 but illustrating a modification of the arrangement shown in FIG. 19.

FIG. 20 shows a modification of the arrangement shown in FIG. 19. The illustrated arrangement is different from that shown in FIG. 19 only in that in FIG. 20, a rotatable polarizer 58 is substituted for the polarizer 56 and a 90° phase switch 60 is connected in each pair of the coaxial lines **48*a* and 48*b***.

The rotatable polarizer 58 can be mechanically controlled to permit the conical horns 16 to radiate either linearly or circularly polarized waves. Also, the 90° phase switch 60 can switch a phase difference between the two dipole anntennas forming an associated one of the crossed dipole antenna 20 from 0 to 90 degrees and vice versa. Thus, radiant waves from the crossed dipole antennas 20 are changed from one to the other of the linearly and circularly polarized waves.

In the arrangement shown in FIG. 20, the influence of the input standing wave ratio is retained as small as in that shown in FIG. 19 because each pair of couplers **52*a* and 52*b* are disposed within the associated section of the primary waveguide 46** at an interval equal to a quarter of the wavelength $\lambda_g$ therein or to any odd multiple thereof.

In the arrangements shown in FIGS. 19 and 20, the main signal paths extending from the transmission source 24 to the conical horns 16 is formed of waveguide system components which are high in handling power and low in loss as feeder lines and radiating elements, for example, conical horns and sections of waveguide. This is because high power signals flow generally through the main signal paths. On the other hand, low power signals flow generally through subsidiary signal paths each extending from the coupler **52*a* or 52*b*** to an associated one of the orthogonal dipole antennas of each crossed dipole antenna. This is because that area of the reflector's aperture blocked by the primary array antenna is usually low relative to the entire area thereof. Since the electric power which is supplied to the subsidiary array antenna is sufficient to eliminate the influence of the blocking, a ratio of the electric power flowing through the subsidiary signal path to the electric power flowing through the main signal path is relatively small. That is, the secondary signal path has a relatively low power flowing therethrough. Accordingly, the subsidiary signal path is formed of the components which are relatively low in handling power and the subsidiary array antenna is disposed as an accessory of the primary radiator. Thus, it is important to consider that the subsidiary array antenna itself should not block the aperture of the reflector. Accordingly, the subsidiary signal paths are required to be formed of components which are as small-sized and light as possible. This results in the use of structural components of the coaxial system such as coaxial lines and dipole antennas.

However, when the subsidiary signal paths are of the coaxial system, insertion losses increase. The insertion loss may be decreased by using coaxial lines having losses as low as possible which reaches a limit. As a result, it will be necessary to compensate for the losses by increasing the coupling ratio of each coupler 52*a* or 52*b*. This measure deteriorates the frequency characteristic of the input standing wave ratio of the coupler because of the general properties thereof resulting in the disadvantage that the resulting reflections increase reflection losses, and cause errors in both the amplitude and phase on both the primary and subsidiary signal paths.

Figure 21:
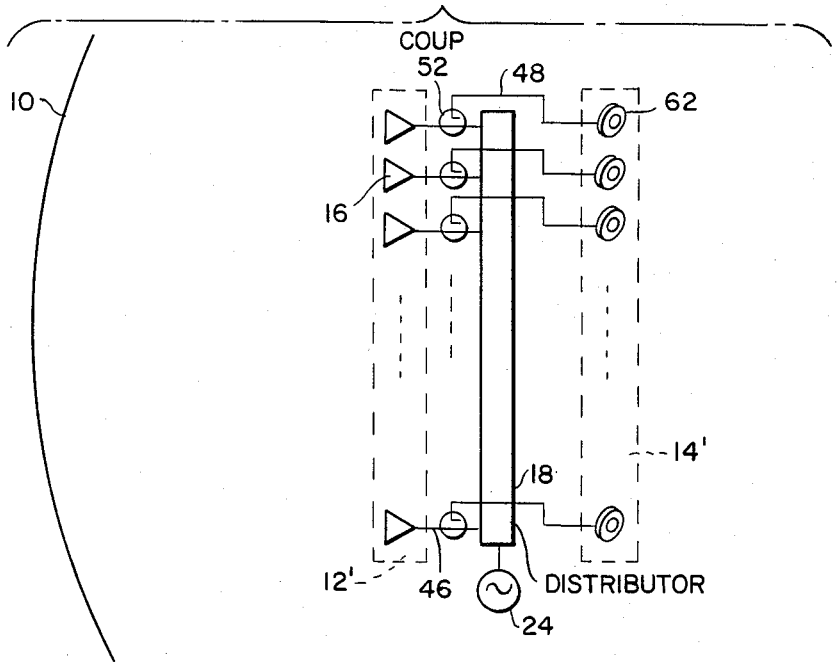
FIG. 21 is a plan view of a further modification of the present invention.

Those disadvantages can be eliminated by a further modification of the present invention as shown in FIG. 21. The illustrated arrangement is different from that shown in FIG. 14 only in that in FIG. 21, the conical horns 16 are directly connected to a distributor 18, which has been substituted for the serpentine feed line 50, and connected to couplers 52 through respective sections of primary waveguide 46 each including a single coupler 52 which is connected to a coaxial line 48 form the subsidiary feeder line which is subsequently connected to an associated one of a plurality of short backfire (which is abbreviated hereinafter to an "SBF") antennas 62. The SBF antennas 62 form the radiating elements in the subsidiary array antenna 14'.

The illustrated arrangement is substantially similar in operation to that shown in FIG. 14.

It is to be understood that the electrical length of the coaxial lines 48 is properly selected to permit the secondary radiated beam from the reflector 10 to coincide in phase with the radiated beam from the subsidiary array antenna while the coupling ratio of the coupler 52 is properly determined so that the radiated beam from the subsidiary array antenna can compensate for that portion of the secondary radiated beam which is about due to the blocking of the primary array antenna.

The SBF antenna is small-sized and light in weight but high in antenna gain. The use of the SBF antenna is effective for decreasing the coupling ratio of the couplers 52 with the coaxial lines 48 remaining unchanged in loss and is suitable for use as a small-sized antenna which does not increase the blocking of the reflector's aperture.

Figure 22:
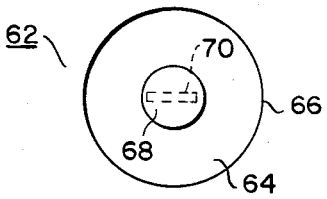
FIG. 22 is a front view of the short backfire antenna shown in FIG. 21.
Figure 23:
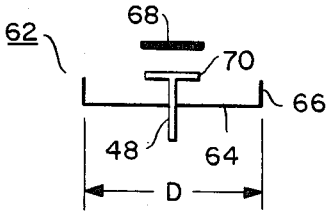
FIG. 23 is a side elevational view of the short backfire antenna shown in FIG. 22.

FIGS. 22 and 23 are respectively a front and side elevational views of the SBF antenna 62 shown in FIG. 21. The illustrated arrangement comprises a reflecting ground plate 64 in the form of a disc including a reflecting peripheral wall 66 extending in an upward direction as viewed in FIG. 23 from the periphery thereof, and small reflecting plate 68 in the form of a disc disposed in a parallel relationship above the ground plate 64. A dipole antenna 70 is disposed between the reflecting plate 68 and the ground plate 64 so as to be parallel to the ground plate 64 and substantially flush with the free end of the peripheral wall 66; the antenna 70 is connected to the coaxial line 48.

It is well known that with a signal with a wavelength $\lambda$ applied to the SBF antenna, the spacing between the dipole antenna 70 and the small reflecting plate 68 and the spacing between the dipole antenna 70 and the reflecting ground plate 64 are usually respectively equal to $\lambda/4$ and $\lambda/2$. The peripheral wall 66 has a height of from $\lambda/4$ to $\lambda/2$ and the ground plate 64 has a diameter D ranging from 1.5 to $2\lambda$. With such figures, the SBF antenna has an antenna gain of from 12 to 15 dB. This figure of the antenna gain may be exhibited by Yagi antennas and horn antennas but the SBF antenna is excellent in that the height thereof can be as low as on the order of $\lambda/2$ when used as the subsidiary radiating element in the antenna system of the present invention. In other words, the SBF antenna may be used as a subsidiary radiating element which minimizes the influence of the blocking and has a high gain.

Figure 24:
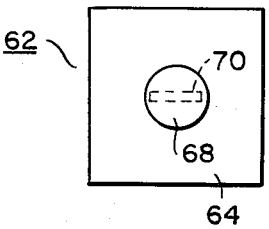
FIG. 24 is a front view of a modification of the arrangement shown in FIG. 22.

FIG. 24 shows a front view of a modification of the SBF antenna shown in FIGS. 22 and 23. In FIG. 24, the reflecting ground plate 62 is shown as being square.

Figure 25:
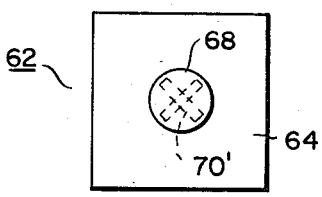
FIG. 25 is a view similar to FIG. 24 but illustrating another modification of the arrangement shown in FIG. 22.

When the arrangement of FIG. 21 is arranged to radiate a circularly polarized wave by adding a polarizer or a circularly polarized wave generator, a 90° hybrid circuit etc. thereto, the dipole antenna 70 shown in FIGS. 22 and 23 or FIG. 24 may be replaced by a crossed dipole antenna 62 as shown in FIG. 25.

While the present invention has been illustrated and described in conjunction with several preferred embodiments thereof it is to be understood that numerous changes and modifications may be resorted to without departing from the spirit and scope of the present invention. For example, the present invention has been illustrated and described in conjunction of the transmission of signals but it is to be understood that the same is equally applicable to the reception of signals. In the latter case a receiver may be substituted for the transmission source 24. Also, it is to be understood that the present invention is not restricted to or by the type of the reflector and array antenna and it is equally applicable to reflector antennas of the offset feeding type. Furthermore, the radiating element used with the present invention is not restricted to a conical horn.

What we claim is:

1. An antenna system comprising a reflector, a primary radiator positioned in front of an aperture of said reflector so as to block one portion of said aperture of said reflector, a transmission source, a subsidiary radiator which is substantially equal in its dimensions to an aperture of said primary radiator and which is disposed back-to-back with respect to said primary radiator, a coupler means for supplying one portion of an electric power output from said transmission source to said subsidiary radiator, and a regulation means for causing a secondary radiation pattern from said reflector to coincide in phase with a radiation pattern from said subsidiary radiator and for regulating a field intensity from said subsidiary radiator; wherein said radiation pattern of said subsidiary radiator compensates for a portion of said radiation pattern from said reflector which is blocked by said primary radiator.

2. An antenna system as claimed in claim 1, wherein each of said primary and subsidiary radiators comprises a phased array antenna for electronically effecting beam scanning.

3. An antenna system as claimed in claim 1, wherein said regulation means includes at least one of a phase regulator means and an amplitude regulator means connected between said coupler means and said subsidiary radiator.

4. An antenna system as claimed in claim 1, wherein said antenna system functions as a receiving antenna by substituting a receiver for said transmission source.

5. An antenna system comprising a reflector, a primary array antenna positioned in front of an aperture of said reflector so as to block one portion of said aperture of said reflector, said primary array antenna having a plurality of radiating elements and functioning as a primary radiator, a subsidiary array antenna which is disposed back-to-back with respect to said primary array antenna and which has subsidiary radiating elements whose number is not greater than that of said radiating elements of said primary array antenna, said subsidiary array antenna functioning as a subsidiary radiator, and a coupler and a delay line connected between each of said radiating elements in said primary array antenna and a corresponding one of said subsidiary radiating elements; wherein a radiation pattern of said subsidiary radiator compensates for a portion of a radiation pattern from said reflector which is blocked by said primary array antenna.

6. An antenna system as claimed in claim 5, wherein each of said primary and subsidiary array antennas comprises a phased array antenna for electronically effecting beam scanning and wherein at least one of a switched delay line and a variable phase shifter is connected between each of said radiating elements of said primary array antenna and a corresponding one of said subsidiary radiating elements.

7. An antenna system as claimed in claim 5, wherein intervals at which said radiating elements are arranged in said primary array antenna are different from intervals at which said subsidiary radiating elements are arranged.

8. An antenna system for simultaneously radiating a pair of radiant beams having frequencies $f_1$ and $f_2$, said pair of beams being radiated in a pair of different directions, said system comprising: a reflector, an array antenna used as a primary radiator and positioned in front of an aperture of said reflector so as to block one portion of said aperture of said reflector, said array antenna having a plurality of radiating elements, a subsidiary array antenna which is disposed back-to-back with respect to said array antenna, said subsidiary array antenna having subsidiary radiating elements whose number is not greater than that of said radiating elements of said array antenna, wherein an electrical power with frequencies $f_1$ and $f_2$ which is supplied to said radiating elements is also partly supplied to said subsidiary radiating elements through couplers, and wherein said subsidiary array antenna radiates a double beam pattern at either of said frequencies $f_1$ and $f_2$, and having a means for causing a phase difference between a pair of beams which are contained in said double beam pattern; wherein a radiation pattern of said subsidiary array antenna compensates for a portion of a radiation pattern of said reflector which is blocked by said array antenna.

9. An antenna system as claimed in claim 8, wherein said radiating elements of said array antenna are coupled in a criss-cross connection arrangement to said subsidiary radiating elements.

10. An antenna system comprising a reflector, an array antenna used as a primary radiator and positioned in front of an aperture of said reflector so as to block one portion of said aperture of said reflector, said array antenna having a plurality of radiating elements, a subsidiary array antenna which is disposed back-to-back with respect to said array atenna, said subsidiary array antenna having subsidiary radiating elements whose number is not greater than that of said radiating elements of said array antenna wherein an electrical power which is fed to said radiating elements of said array antenna is partly supplied to said subsidiary radiating elements through a coupling means, said coupling means having a pair of couplers which are connected at an interval to a feeder line which is connected to each of said radiating elements, said interval d being determined by $$d = \lambda_g\left(\tfrac{1}{4} + \frac{n}{2}\right) \quad \text{for } n = 0, 1, 2, \ldots$$

where $\lambda_g$ designates a wavelength of said electrical power propagating along said feeder line; wherein a radiation pattern of said subsidiary array antenna compensates for a portion of a radiation pattern of said reflector which is blocked by said array antenna.

11. An antenna system as claimed in claim 10, wherein a rotatable 90° phase switch is connected to each of said subsidiary radiating elements.

12. An antenna system comprising a reflector, an array antenna used as a primary radiator and positioned in front of an aperture of said reflector so as to block one portion of said aperture of said reflector, said array antenna having a plurality of radiating elements, and a subsidiary array antenna which is disposed back-to-back with respect to said array antenna, said subsidiary array antenna having subsidiary radiating elements whose number is not greater than that of said radiating elements of said array antenna and said subsidiary radiating elements being supplied with one portion of an electrical power which is supplied to said radiating elements of said array antenna through a coupler means, each of said subsidiary radiating elements being formed of a short backfire antenna having: a reflecting ground plate, a reflecting peripheral wall extending from the periphery of the reflecting ground plate, a small reflecting plate disposed above said reflecting ground plate and a dipole antenna disposed between said small reflecting plate and said reflecting ground plate; wherein a radiation pattern of said subsidiary array antenna compensates for a portion of a radiation pattern of said reflector which is blocked by said array antenna.

* * * * *